US007484923B2

(12) United States Patent
Haas et al.

(10) Patent No.: US 7,484,923 B2
(45) Date of Patent: Feb. 3, 2009

(54) PACKAGING APPARATUS FOR PACKAGING RIGID CONTAINERS IN DIMENSIONALLY STABLE WRAPPERS

(75) Inventors: Johann Haas, Klosterneuburg (AT); Stefan Jiraschek, Königsbrunn (AT); Josef Haas, Jr., Vienna (AT); Norbert Drapela, Langenzersdorf (AT); Gottfried Stilling, Vienna (AT)

(73) Assignee: Franz Haas Waffel - und Keksanlagen -Industrie GmbH, Vienna (AT)

( * ) Notice: Subject to any disclaimer, the term of this patent is extended or adjusted under 35 U.S.C. 154(b) by 0 days.

(21) Appl. No.: 11/268,231

(22) Filed: Nov. 7, 2005

(65) Prior Publication Data

US 2006/0102647 A1 May 18, 2006

Related U.S. Application Data

(63) Continuation of application No. PCT/EP2004/004457, filed on Apr. 28, 2004.

(30) Foreign Application Priority Data

May 6, 2003 (AT) ..... A 681/2003

(51) Int. Cl.

| | |
|---|---|
| ***B65G 59/10*** | (2006.01) |
| ***B65G 59/02*** | (2006.01) |
| ***B65G 59/06*** | (2006.01) |
| ***B23Q 7/04*** | (2006.01) |
| ***B65B 35/56*** | (2006.01) |
| ***B65B 43/14*** | (2006.01) |

(52) U.S. Cl. ..... 414/795.6; 221/211; 53/142; 53/250; 53/571; 426/139; 414/797; 414/797.4; 414/797.8; 414/798.1

(58) Field of Classification Search ..... 53/446, 53/142, 251, 473, 475, 544, 397, 580, 582, 53/585; 426/139, 135; 414/798.3, 798.4, 414/793, 797, 788.3, 795.6, 979.4, 797.8, 414/798.1; 209/905, 911; 221/211, 221, 221/238; 198/418.3

See application file for complete search history.

(56) References Cited

U.S. PATENT DOCUMENTS 2,917,882 A * 12/1959 Buck ..... 53/543

(Continued)

FOREIGN PATENT DOCUMENTS

DE 23 51 244 4/1975

(Continued)

*Primary Examiner*—Gregory W Adams
(74) *Attorney, Agent, or Firm*—Laurence A. Greenberg; Werner H. Stemer; Ralph E. Locher

(57) ABSTRACT

An apparatus is provided for the individual production of rigid containers that are open on one side, such as cones or cups, by inserting the containers into dimensionally stable individually produced sleeves which are matched to their external contour. The containers are transported through by a transport apparatus having a plurality of transport tracks lying beside one another under a discharge apparatus, which deposits the sleeves in the transport tracks. The discharge apparatus includes a support provided with discharge channels extending obliquely downward for the bar-shaped stacks of sleeves, a holding apparatus disposed downstream of the support, for the stacks of sleeves, and a transfer apparatus having a carriage which is provided with suction heads, can be moved back and forth above the transport tracks and draws the sleeves off the stacks of sleeves with its suction heads and deposits them on the transport tracks.

11 Claims, 3 Drawing Sheets

U.S. PATENT DOCUMENTS

| | | | | | |
|---|---|---|---|---|---|
| 3,077,983 | A | * | 2/1963 | Middleditch | 209/534 |
| 4,565,478 | A | * | 1/1986 | Ericsson | 414/792.9 |
| 4,717,026 | A | * | 1/1988 | Fischer et al. | 209/539 |
| 5,755,074 | A | * | 5/1998 | Fetters | 53/69 |
| 5,918,765 | A | | 7/1999 | Blankenship et al. | |
| 6,024,530 | A | * | 2/2000 | Kleineisel et al. | 414/752.1 |
| 6,044,886 | A | * | 4/2000 | Mueller | 156/443 |

FOREIGN PATENT DOCUMENTS

| | | | |
|---|---|---|---|
| DE | 26 57 021 | | 6/1978 |
| EP | 1 120 045 | A1 | 8/2001 |
| GB | 2 022 553 | A | 12/1979 |
| JP | 11 105828 | | 4/1999 |
| NL | 7908330 | | 6/1981 |

* cited by examiner

PACKAGING APPARATUS FOR PACKAGING RIGID CONTAINERS IN DIMENSIONALLY STABLE WRAPPERS

CROSS-REFERENCE TO RELATED APPLICATION

This is a continuing application, under 35 U.S.C. §120, of copending International Application No. PCT/EP 2004/004457, filed Apr. 28, 2004, which designated the United States; this application also claims the priority, under 35 U.S.C. §119, of Austrian Patent Application A 681/2003, filed May 6, 2003; the prior applications are herewith incorporated by reference in their entirety.

BACKGROUND OF THE INVENTION

Field of the Invention

The invention relates to an apparatus for the individual packaging of rigid containers that are open on one side, such as cones, cups, waffle cones, waffle cups, ice cream cones, ice cream cups and the like, by inserting the containers into dimensionally stable individually produced sleeves matched to their external contour. The dimensionally stable individually produced sleeves can be produced from paper or thin films and can have a cone-shaped, cup-shaped, etc. configuration corresponding to the external contour of the containers.

German Published, Non-Prosecuted Patent Application DE 26 57 021 A discloses a packaging apparatus for waffle cones, in which the waffle cones lying in transport channels disposed beside one another at relatively large distances are in each case pushed with the tip forward into film cones lying in front of them, which have been drawn off from a discharge apparatus disposed above the transport channels from the front pointed ends of a plurality of stacks of cones disposed beside one another and then introduced into the transport channels. The stacks of cones lie on discharge channels running obliquely downward and, with their pointed, front ends projecting beyond the lower ends of the discharge channels, stick into gripping funnels, disposed beside one another, of a cone withdrawal apparatus. The cone withdrawal apparatus sticks into the tip of the lowest cone of the respective stack of cones stuck in the respective gripping funnel with its needles, which can each be displaced radially in the gripping funnels. The cone withdrawal apparatus subsequently withdraws the cones fixed in its gripping funnels forward from the obliquely located stacks of cones and pivots the cones held firmly by it with their open rear ends downward toward the transport channels. Then, in the gripping funnels, the needles are withdrawn from the tips of the cones and the film cones fall downward from the cone withdrawal apparatus and land in the transport channels in front of the waffle cones. An operating arm of a slider which travels back and forth is then pivoted into the transport channels behind the waffle cones and the waffle cones are pushed by the slider firstly into the film cones located in front of them and then, together with the latter, are pushed out of the individual production apparatus.

Austrian Patent AT 347 884 B discloses a packaging apparatus for waffle cones in which paper cones are withdrawn from the pointed, lower ends of stacks of paper cones disposed upright and are allowed to fall into curved chutes which feed the paper cones sliding down in them under the force of gravity to transport channels of the waffle cones which are adjacent the lower ends of the chutes.

SUMMARY OF THE INVENTION

It is accordingly an object of the invention to provide an apparatus for the packaging of rigid containers that are open on one side, which overcomes the hereinafore-mentioned disadvantages of the heretofore-known devices of this general type.

With the foregoing and other objects in view there is provided, in accordance with the invention, an apparatus for the packaging of rigid containers which are open on one side, by inserting the containers into dimensionally stable individually produced sleeves that are matched to their external contour. This individual production apparatus has a transport apparatus having transport tracks lying beside one another and extending in the longitudinal direction for the containers, and a discharge apparatus disposed above the transport apparatus for discharging the individually produced sleeves to the container transport tracks of the transport apparatus. The discharge apparatus has discharge channels which are aligned with the container transport tracks and extend obliquely downward, on which there lie stacks of individually produced sleeves that, at their lower ends, are held by the holding apparatus which, with its mutually opposite holding jaws, in each case acts on the upper end section of the lowest individually produced sleeve of each stack projecting beyond these holding jaws in the longitudinal direction. This holding apparatus has a transfer apparatus disposed downstream which has a carriage that can be moved back and forth in the longitudinal direction between a rear and a front operating position. The carriage carries pneumatically operated suction heads respectively assigned to the discharge channels, with the aid of which the lowest individually produced sleeves of the stacks projecting beyond the discharge channels in the longitudinal direction are firmly sucked onto the carriage in the rear operating position of the carriage and, during the forward movement of the carriage, are drawn off the stacks and, in the front operating position of the carriage, are released and deposited in the container transport tracks of the transport apparatus.

In accordance with another feature of the invention, the transport tracks of the containers are provided with transverse steps disposed in the region of the transfer apparatus. The transfer apparatus can be associated with blower nozzles which are orientated rearward, with which the individually produced sleeves deposited on the transport tracks can be pushed rearward as far as the transverse steps, in order to align them in the transverse direction.

In accordance with a further feature of the invention, the suction heads fitted to the carriage of the transfer apparatus each have two respective pneumatically operated suction cups disposed one behind another in the longitudinal direction.

In accordance with an added feature of the invention, the holding apparatus disposed downstream of the discharge channels for the stacks of individually produced sleeves has a lower holding jaw associated with the lower edges of the stacks and an adjustable upper holding jaw associated with the upper edges of the stacks. These holding jaws can be formed as elongated transverse bars, from which holding projections that can be brought into engagement with the lowest individually produced sleeve of a stack respectively project.

In accordance with an additional feature of the invention, the discharge apparatus has an automatic forward feed device for the stacks of individually produced sleeves in the region of the discharge channels extending obliquely downward. This forward feed device can be formed by weighted pieces supported on rollers in the discharge channels, which bear on rear ends of the stacks of individually produced sleeves.

In accordance with yet another feature of the invention, there are provided rear light barriers for monitoring the configuration of the containers introduced into the individual production apparatus. The rear light barriers are provided upstream of the transfer apparatus and associated with the transport tracks of the transport apparatus lying beside one another.

In accordance with yet a further feature of the invention, there are provided front light barriers for monitoring the configuration of the individually produced sleeves introduced into the transport tracks. The front light barriers are disposed in the region of the front operating position of the carriage of the transfer apparatus and are associated with the transport tracks of the transport apparatus lying beside one another.

In accordance with a concomitant feature of the invention, in the region of the transfer apparatus, the transport apparatus has one or more lower output openings which are assigned to the transport tracks, which can be closed, and through which the containers not pushed into an individually produced sleeve can be separated out from the individual production apparatus according to the invention.

Through the use of the packaging apparatus according to the invention, rigid containers open on one side and formed as cones or cups, such as waffle cones and ice cream cones or waffle cups and ice cream cups, can be individually placed in sleeves. In the case of the cone-shaped containers, cone-shaped individually produced sleeves are used and in the case of cup-shaped containers, cup-shaped individually produced sleeves are used. The individually produced sleeves are dimensionally stable and respectively matched to the external contour of the containers. The individually produced sleeves can be closed or open at their lower end associated with the lower, closed end of the containers. The individually produced sleeves, open toward the bottom and placed on the container, form a sheath surrounding the respective container on the outside, which can carry a label and can be formed as a guard against touching the container.

Other features which are considered as characteristic for the invention are set forth in the appended claims.

Although the invention is illustrated and described herein as embodied in an apparatus for the packaging of rigid containers that are open on one side, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
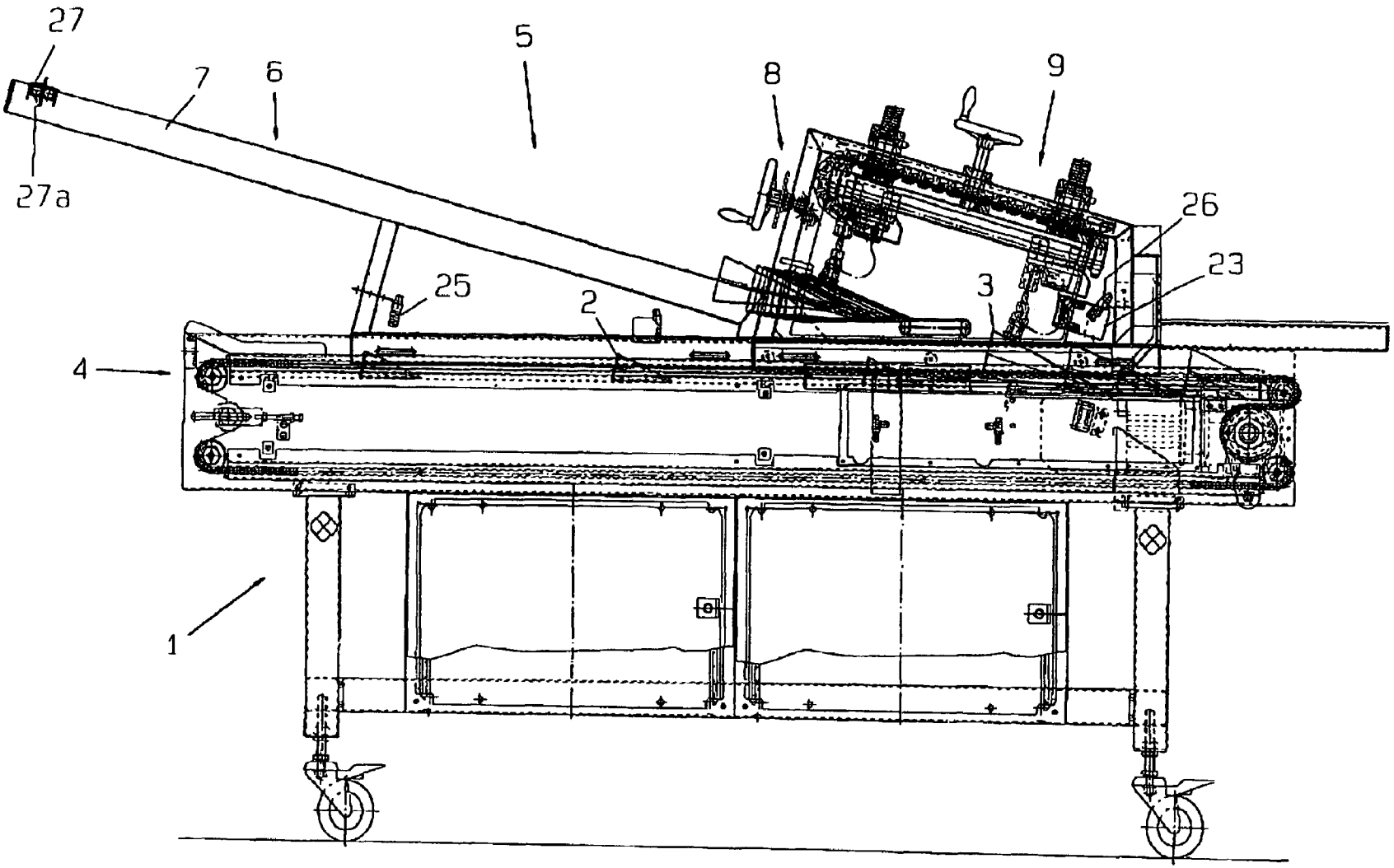
FIG. 1 is a diagrammatic, partly broken-away, side-elevational view of a packaging apparatus.

Referring now to the figures of the drawings in detail and first, particularly, to FIG. 1 thereof, there is seen an apparatus 1 for the packaging of rigid containers 2 that are open on one side, by inserting the containers 2 into dimensionally stable individually produced sleeves 3 matched to their external contour. Containers 2 which are formed, for example, as cones or cups, such as waffle cups or waffle cones, can be inserted into cone-shaped or cup-shaped individually produced sleeves 3, which are produced from paper or films printed on the outside, by using this individual production apparatus 1. The individually produced sleeves 3 have an open rear end and taper forward to a point. It is possible for the front end to be closed or open.

The containers illustrated in the drawings are rigid waffle cones 2, which are inserted into considerably larger paper cones 3.

In the packaging apparatus 1, the waffle cones 2 are transported through under a discharge apparatus 5 by a transport apparatus 4, which has a plurality of transport tracks lying beside one another and extending in the longitudinal direction. The discharge apparatus 5 provides a support 6 for a plurality of stacks of paper cones disposed beside one another with their pointed ends pointing forward. The paper cones lie on discharge channels 7 which run obliquely downward and are aligned with the transport tracks. Lower ends of the paper cones are held by a holding apparatus 8 which is disposed downstream of a transfer apparatus 9, that draws the leading paper cone off each individual stack of paper cones and deposits it in the transport track of the transport apparatus 4 belonging to the respective discharge channel 7.

Figure 2:
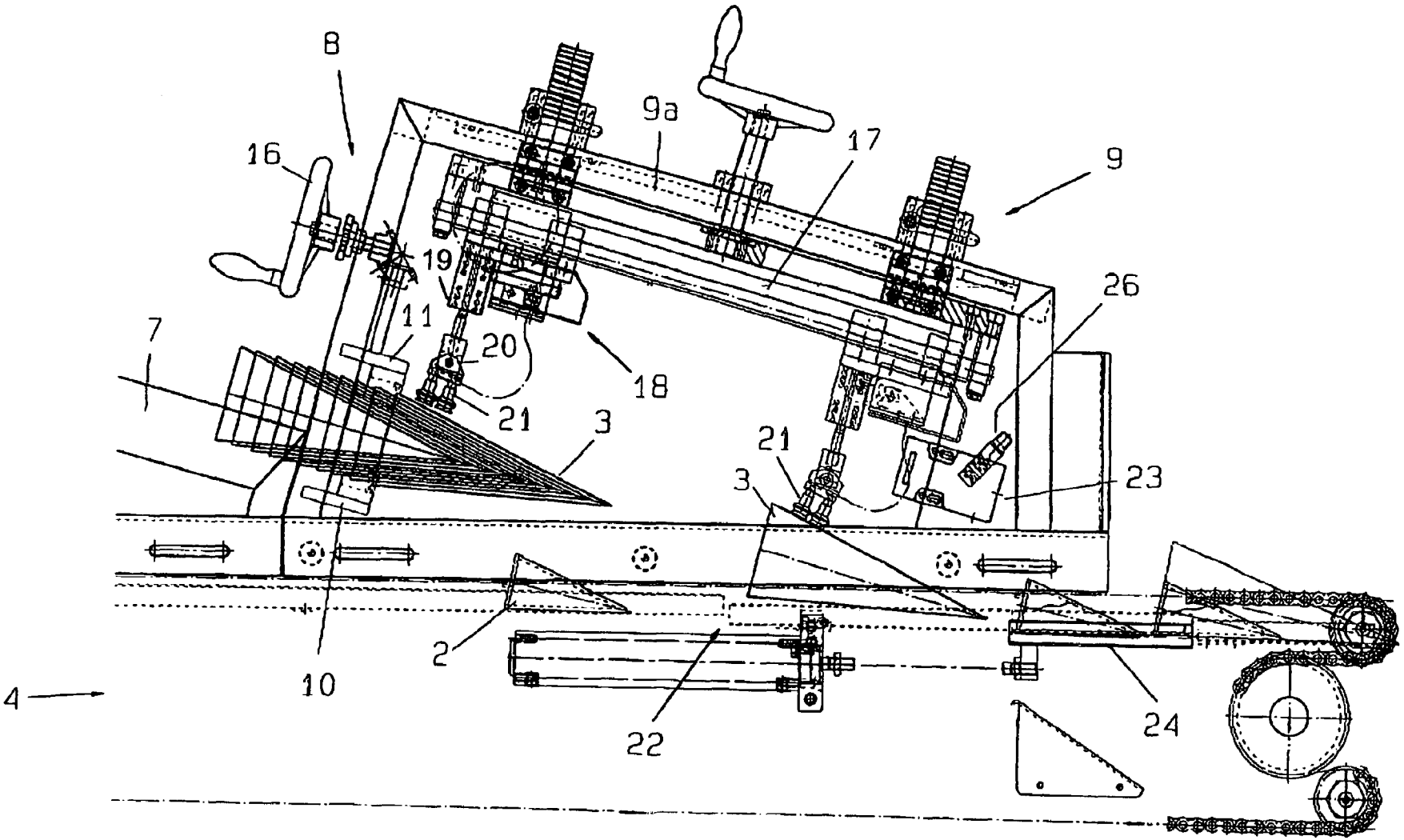
FIG. 2 is an enlarged, fragmentary, side-elevational view of a front region of a discharge apparatus with a carriage of a transfer apparatus in its rear and front operating position.
Figure 3:
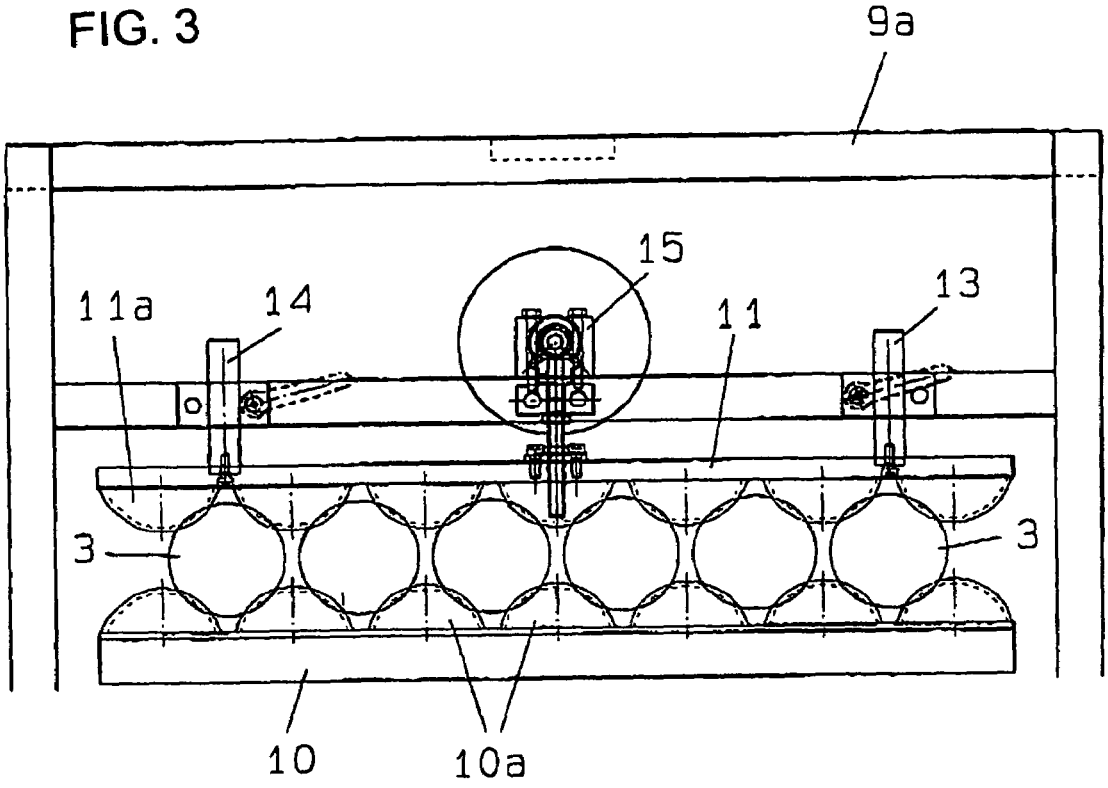
FIG. 3 is a further enlarged, fragmentary, rear-elevational view of a front region of the discharge apparatus.

As is seen in FIG. 2, the holding apparatus 8 has two holding jaws 10 and 11 which are disposed at the lower end of the discharge channels 7, extend in the transverse direction and are mutually opposite each other at right angles to the plane of the discharge channels 7. As is seen in FIG. 3, lower holding projections 10*a* project upward from the lower holding jaw 10, are aligned with the discharge channels 7 and are disposed beside one other at a distance. The upper holding jaw 11 carries upper holding projections 11*a* which project downward therefrom and are aligned with the lower holding projections 10*a*. The holding projections 10*a* and 11*a* are formed by semicircular disks, which are respectively disposed between two adjacent stacks of paper cones and engage with the lowest paper cones of the two stacks.

The upper holding jaw 11 is guided displaceably in a frame 9*a* of the transfer apparatus 9, in a plane running at right angles to the discharge channels 7, by guide pins 13, 14 projecting upward from the upper holding jaw 11. The frame 9*a* of the transfer apparatus 9 carries an adjusting apparatus 15 associated with the upper holding jaw 11, which is equipped with a hand wheel 16 for adjusting the position of the upper holding jaw 11. With the aid of the adjusting apparatus 15, not only can a distance between the upper holding jaw 11 and the lower holding jaw 10 be set to the size of the paper cones of the stacks of paper cones, but a holding force with which the stacks of paper cones are held firmly by the holding apparatus 8 can also be set and changed.

In the holding apparatus 8, the stacks of paper cones are disposed with their lowest paper cones between the holding projections 11*a*, 10*a* of the two holding jaws 10, 11. The two holding jaws 10, 11 act on the upper end sections of the lowest paper cones which, in turn, project obliquely downward beyond the two holding jaws 10, 11 and project into the operating range of the transfer apparatus 9.

The transfer apparatus 9 has a slide guide 17 which is parallel to the oblique plane of the discharge channels 7, extends in the longitudinal direction and on which a carriage 18 is mounted in such a way that it can be displaced in the longitudinal direction. The carriage 18 has a crossmember 19 extending in the transverse direction, on which pneumatically operated suction heads 20 respectively assigned to the discharge channels 7 are fixed. Each suction head 20 has two pneumatically operated suction cups 21 disposed one behind the other in the longitudinal direction. The carriage 18 can be moved rearward as far as a rear operating position. In the latter, its suction cups 21 are located above the side walls, projecting forward beyond the holding apparatus, of the lowest paper cones of the stacks of paper cones lying on the discharge channels 7. In the rear operating position of the carriage 18, the suction cups 21 are operated pneumatically in order to grip the paper cones and to hold them firmly on the carriage 18. The carriage 18 is then moved forward into its front operating position. In the latter, the paper cones held firmly by the suction cups 21 are located slightly above the transport tracks of the transport apparatus 4. In the front operating position of the carriage 18, the suction cups 21 are once again operated pneumatically, this time in order to release the paper cones and deposit them in the transport tracks of the transport apparatus 4. The carriage 18 is then moved rearward again into its rear operating position in order to withdraw the next transverse row of paper cones from the stacks of paper cones and to deposit them in the transport tracks of the transport apparatus 4.

A transverse step 22 is formed in each transport track of the transport apparatus 4, in the region of the transfer apparatus 9. The transverse step 22 separates a somewhat higher front section of the transport track from a somewhat lower discharge section of transport track associated with the rear operating position of the carriage 18. Blower nozzles 23, which are oriented rearward, are disposed above these discharge sections of the transport tracks and emit blown air jets which push the paper cones lying on the discharge sections rearward until they rest on the transverse steps 22 and form a transverse row at right angles to the transport direction. The transport apparatus 4 pushes the waffle cones 2 lying on the higher, front sections of the transport tracks over the transverse steps 22 into paper cones 3 deposited on the lower discharge sections of the transport tracks.

The waffle cones lying one behind another at relatively large intervals on the transport tracks are disposed in transverse rows, which are in each case pushed forward in the longitudinal direction of the transport apparatus by a transverse bar belonging to the transport apparatus 4.

Lower output openings which are provided in the lower discharge sections of the transport tracks, are respectively covered at the bottom by a flap 24 to be operated pneumatically.

As is seen in FIG. 1, rear light barriers 25 are provided in a region of the transport tracks of the transport apparatus 4 which is in front of the transfer apparatus. The presence of a waffle cone in each individual transport track is monitored with the rear light barriers 25. If there is ever no waffle cone present in a transport track, then no paper cone, in the discharge apparatus 5, is withdrawn from the stacks of paper cones in the discharge channel 7 associated with this transport track. This is accomplished by not operating the suction cups 21 of the carriage 18 associated with this discharge channel 7 in the rear operating position of the carriage 18, so that no paper cone is deposited in the relevant transport track.

Front light barriers 26, which are disposed in the region of the transfer apparatus 9 associated with the front operating position of the carriage 18, are assigned to the individual transport tracks of the transport apparatus 4. The front light barriers 26 monitor the presence of a paper cone deposited in the respective transport track. If there is ever no paper cone 3 deposited in a transport track in which a waffle cone 2 is lying, then the downward flap 24 covering the lower output opening of this transport track is operated pneumatically, in order to open the output opening and to separate the waffle cone, for which there is no paper cone ready in this transport track, downward out of the transport apparatus 4.

The front and rear light barriers 25 and 26 respectively assigned to a transport track of the transport apparatus 4 ensure that only individually produced waffle cones, that is to say waffle cones respectively inserted into a paper cone, leave the individual production apparatus.

Figure 4:
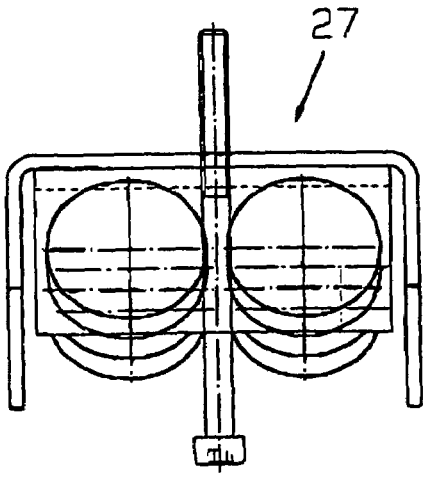
FIG. 4 is an enlarged, side-elevational view of a weighted piece mounted on rollers.
Figure 5:
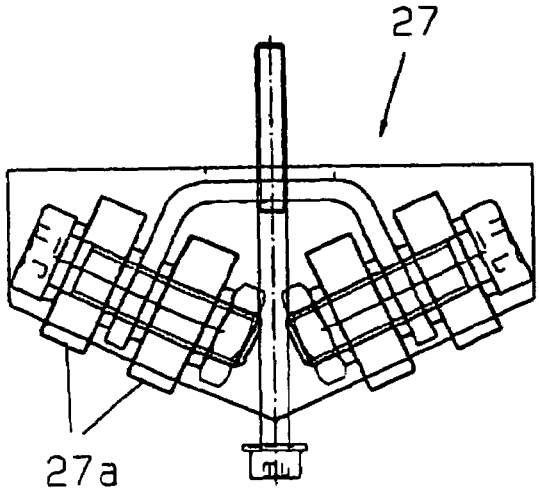
FIG. 5 is an enlarged, front-elevational view of a weighted piece mounted on rollers.

An automatic forward feed device for the stacks of paper cones is provided in the discharge apparatus 5, in the region of the discharge channels 7 extending obliquely downward, as seen in FIGS. 4 and 5. This forward feed device is formed by weighted pieces 27 respectively supported on rollers 27*a* in the discharge channels 7, which bear against the rear ends of the stacks of paper cones.

We claim:

1. A packaging apparatus for packaging rigid containers that are open at an open end and closed at a smaller sized closed end opposite the open end, by placing the containers into dimensionally stable funnel-shaped wrappers that are matched to the outer contour of the containers, the packaging apparatus comprising:

a lower horizontal conveying device having a horizontal conveying path configured for conveying the containers in a lying position, said horizontal conveying device extending in a downstream direction of the packaging apparatus;

an upper inclined delivery device for the wrappers, said delivery device extending obliquely downward in the downstream direction, said delivery device including:

(a) an inclined storage having a support channel extending obliquely downward in the downstream direction configured for accommodating a stack of recumbent nested wrappers, said support channel having a lower downstream end, the stack having a small-sized lower end at said lower downstream end of said support channel;

(b) a stack holding device disposed in a vicinity of said lower end of said support channel; and (c) an inclined transfer device disposed downstream of said inclined storage, said inclined transfer device including:

(i) a sliding carriage for conveying the wrappers in a recumbent position along an inclined linear moving path starting from a raised upstream position at the small-sized lower end of said stack and to a lower final downstream position in said horizontal conveying path of said lower conveying device;

(ii) an inclined linear slide guide for said sliding carriage, said slide guide being disposed parallel to said inclined linear moving path for the recumbent wrappers, said slide guide being provided with a raised upstream end associated to the downstream end of said inclined storage, said slide guide being provided with a lower downstream end associated to said horizontal conveying path of said lower conveying device;

(iii) said sliding carriage being movable on said inclined linear slide guide from a raised rear position downward to a lowered forward position when transferring a wrapper in a recumbent position along said inclined linear moving path from the small-sized lower end of said stack into said horizontal conveying path of said lower conveying device;

(iv) said sliding carriage having a pneumatically operable suction head for engaging the recumbent wrappers on an outside thereof, said suction head configured for seizing a recumbent wrapper on the outside thereof and fixing the wrapper to said sliding carriage at the raised upstream starting position of said inclined linear moving path, said suction head configured for releasing the recumbent wrapper from said sliding carriage at the lower downstream end of said inclined linear moving path in said horizontal conveying path of said lower conveying device.

2. The apparatus according to claim 1, wherein the rigid containers are selected from the group consisting of cones, cups, wafer cones, wafer cups, ice cream cones and ice cream cups.

3. The apparatus according to claim 1, wherein said suction head projects from the sliding carriage towards said horizontal conveying path, and has two suction cups disposed one behind another in said downstream direction.

4. The apparatus according to claim 1, wherein said horizontal conveying path is provided with a transverse step disposed behind said lower final position of said inclined linear moving path, and a blower nozzle is provided that is directed rearward for pushing a recumbent funnel-shaped wrapper discharged into said horizontal conveying path with the open wrapper end ahead backwards against said transverse step.

5. The apparatus according to claim 1, wherein said holding device has two holding jaws configured for holding the stack of nested funnel-shaped wrappers on said oblique support channel, one of said holding jaws is a stationary lower holding jaw engaging the lower edge of the small-sized lower end of said stack and the other said holding jaw is a vertically adjustable upper holding jaw configured for engaging the upper edge of the small-sized lower end of the stack.

6. The apparatus according to claim 5, wherein said holding jaws are transverse bars having holding projections engaging the lowermost funnel-shaped wrapper of the stack.

7. The apparatus according to claim 1, wherein said delivery device has a forward feeding device for the stack of nested funnel-shaped wrappers arranged on the oblique support channel.

8. The apparatus according to claim 7, wherein said forward feeding device has at least one weighted piece supported on rollers and arranged on the oblique support channel in the back of the stack of nested funnel-shaped wrappers arranged on said oblique support channel.

9. The apparatus according to claim 1, wherein said pneumatically operated suction head is controlled by a rear light barrier disposed at said horizontal conveying path upstream of said transfer device, said rear light barrier monitors a presence of a container in said horizontal conveying path.

10. The apparatus according to claim 1, wherein said transfer device has a front light barrier disposed at said horizontal conveying path in vicinity of said lower final position of said inclined linear moving path, said front light barrier monitors the presence of a wrapper in said horizontal conveying path.

11. The apparatus according to claim 1, wherein said horizontal conveying path has a lower closable output opening disposed in vicinity of said lower final position of said inclined linear moving path.

* * * * *